United States Patent [19]

Foster et al.

[11] Patent Number: 4,756,562

[45] Date of Patent: Jul. 12, 1988

[54] LATCH ASSEMBLY FOR VEHICLES

[75] Inventors: Raymond E. Foster, Lowell; Andrew J. Holwerda, Wyoming; Lynwood C. Kraft, Kentwood; Dale W. Riley, Wyoming, all of Mich.

[73] Assignee: Ryerson & Haynes, Inc., Jackson, Mich.

[21] Appl. No.: 935,502

[22] Filed: Nov. 26, 1986

[51] Int. Cl.[4] ..... E05C 3/08

[52] U.S. Cl. ..... 292/28; 292/DIG. 14; 292/DIG. 53

[58] Field of Search ..... 292/DIG. 14, DIG. 53, 292/336.3, 29, 50, 28

[56] References Cited

U.S. PATENT DOCUMENTS

| | | | |
|---|---|---|---|
| 1,251,223 | 12/1917 | Gundrum . | |
| 2,126,141 | 8/1938 | Saunders | 292/223 |
| 2,211,217 | 8/1940 | Peterson | 292/340 |
| 2,227,144 | 12/1940 | Krause | 292/1 |
| 2,253,660 | 8/1941 | Tell | 292/128 |
| 2,333,466 | 11/1943 | Calud-Mantle | 292/11 |
| 2,492,683 | 12/1949 | Claud-Mantle | 292/DIG. 14 X |
| 2,508,090 | 5/1950 | Beems et al. | 292/129 |
| 2,806,727 | 9/1957 | Johnstone | 292/216 |
| 2,815,822 | 12/1957 | Ramsey | 180/69 |
| 2,841,430 | 7/1958 | Krause | 292/11 |
| 2,877,035 | 3/1959 | Claud-Mantle | 292/DIG. 14 X |
| 2,877,038 | 3/1959 | Kramer | 292/216 |
| 2,912,272 | 11/1959 | Wade | 292/340 |
| 2,924,473 | 2/1960 | Krause | 292/11 |
| 2,955,859 | 10/1960 | Kause et al. | 292/6 |
| 2,996,324 | 8/1961 | Krause | 292/226 |
| 3,003,800 | 10/1961 | Hammond | 292/11 |
| 3,188,126 | 6/1965 | Krause | 292/11 |
| 3,207,543 | 9/1965 | Boyer | 292/DIG. 14 X |
| 3,236,551 | 2/1966 | Nash | 292/DIG. 14 X |
| 3,315,502 | 4/1967 | Skrapits et al. | 70/240 |
| 3,565,476 | 2/1971 | Berman | 292/201 |
| 3,730,575 | 5/1973 | Arlauskas et al. | 292/216 |
| 3,743,335 | 7/1973 | Reilhac et al. | 292/127 |
| 3,767,244 | 10/1973 | Plaw | 292/227 |
| 3,966,244 | 6/1976 | Kleisser et al. | 292/DIG. 14 X |
| 4,456,289 | 6/1984 | Badiali | 292/DIG. 14 X |

FOREIGN PATENT DOCUMENTS

| | | |
|---|---|---|
| 580485 | 7/1959 | Canada . |
| 609896 | 12/1960 | Canada . |
| 1099649 | 1/1968 | United Kingdom . |

*Primary Examiner*—Richard E. Moore

*Attorney, Agent, or Firm*—Price, Heneveld, Cooper, DeWitt & Litton

[57] ABSTRACT

A latch assembly for vehicles is disclosed for securing engine hoods, trunk lids, or other pivotal members to fixed portions of a vehicle. The assembly includes a primary latch preferably releasable from a remote position within the vehicle, and a secondary latch to hold the pivotal member only partially open after release of the primary latch. A secondary latch release handle is mounted for automatic movement into the gap between the partially opened pivotal member and the fixed vehicle portion for easy, convenient access outside the pivotal member to release the secondary latch to fully open the pivotal member. A safety retaining arm is included to hold the pivotal member partially closed even if the fasteners for the latch assembly loosen or fail.

53 Claims, 6 Drawing Sheets

FIG. 1
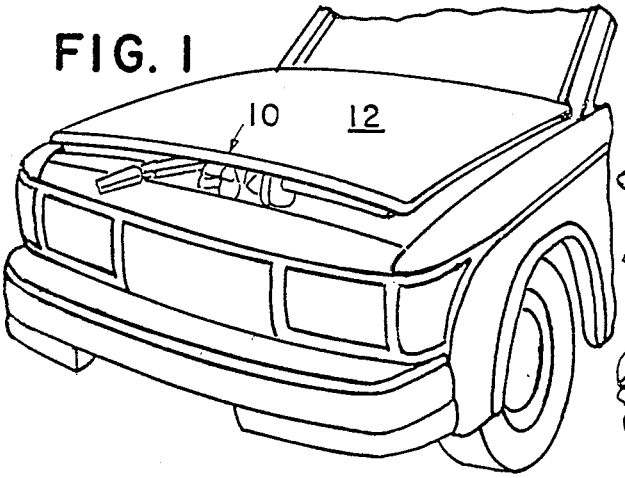
FIG. 2
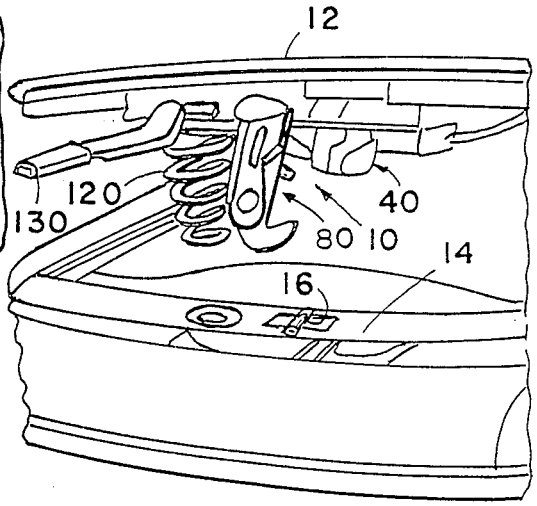
FIG. 3
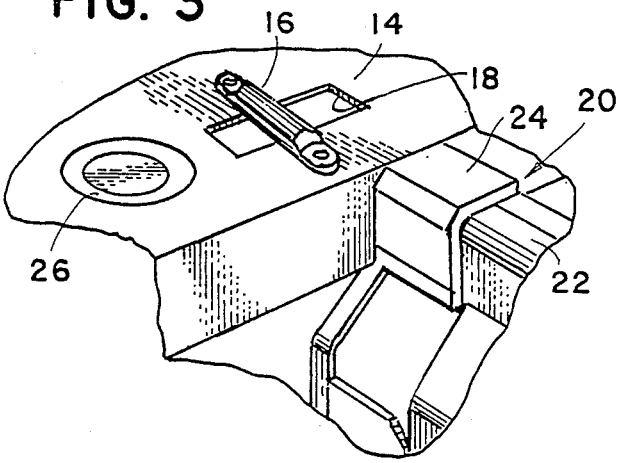
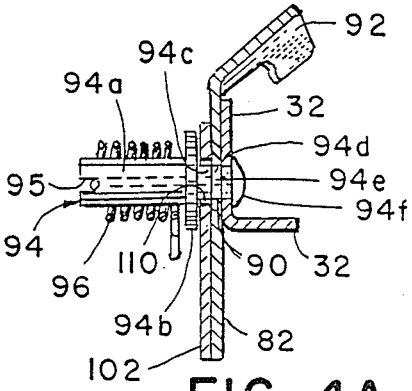
FIG. 4A
FIG. 4
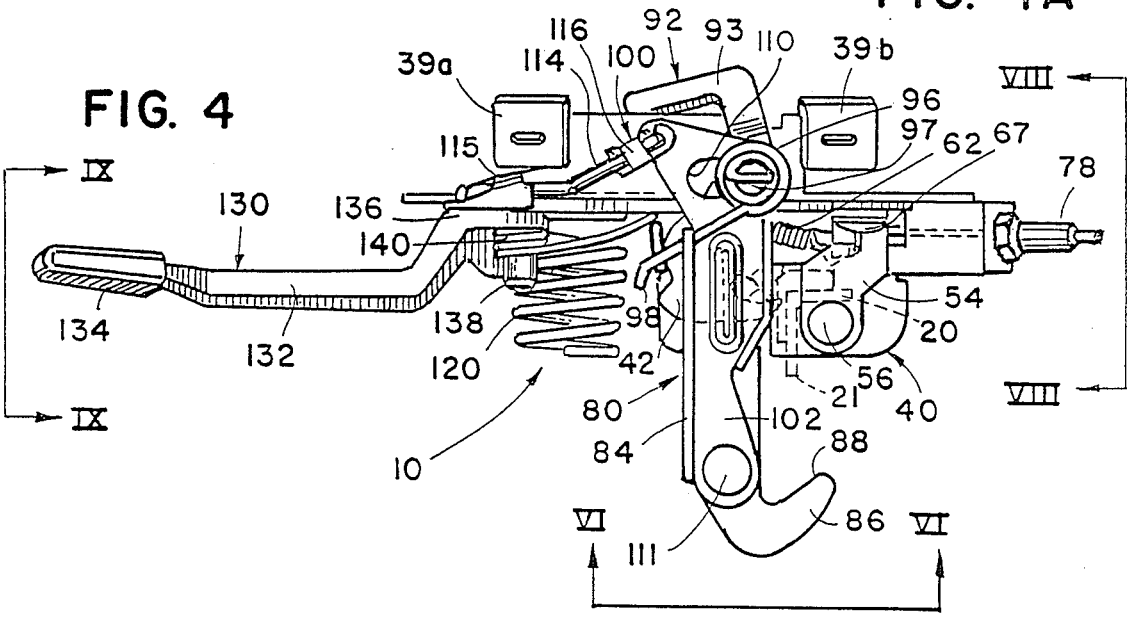

FIG. 5
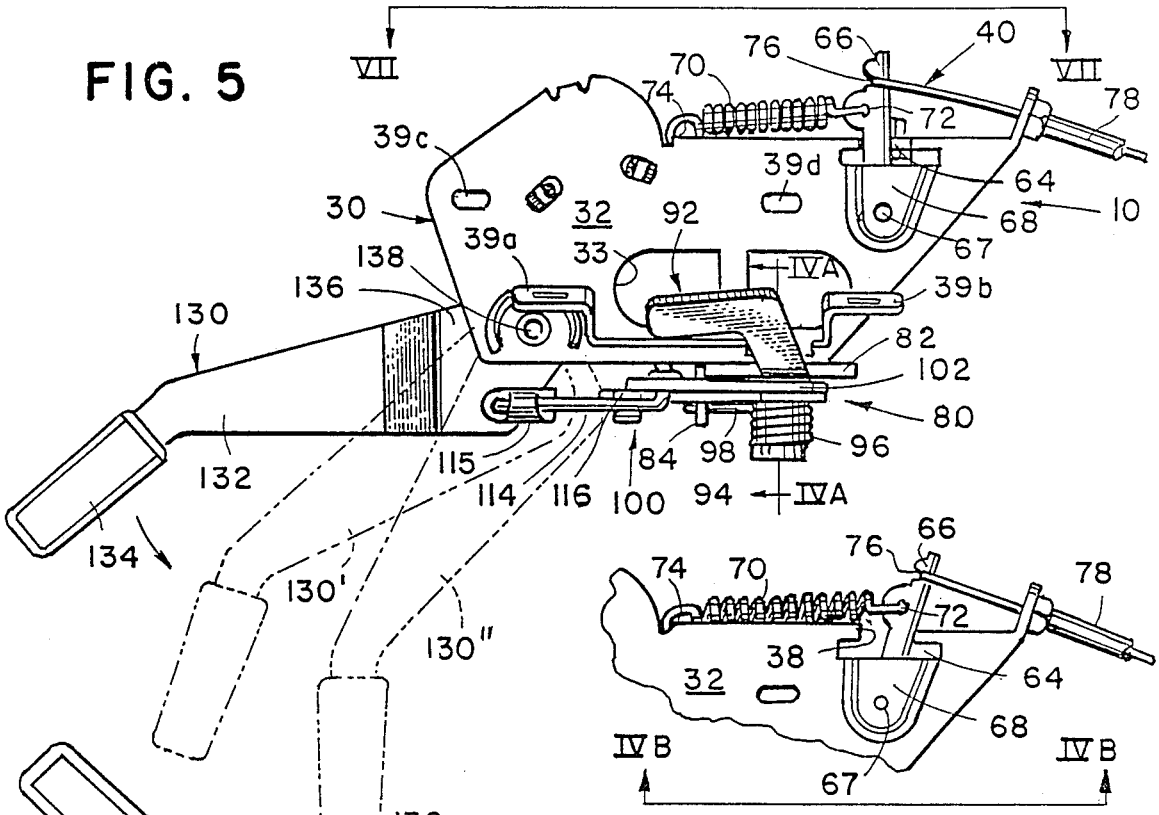
FIG. 5A
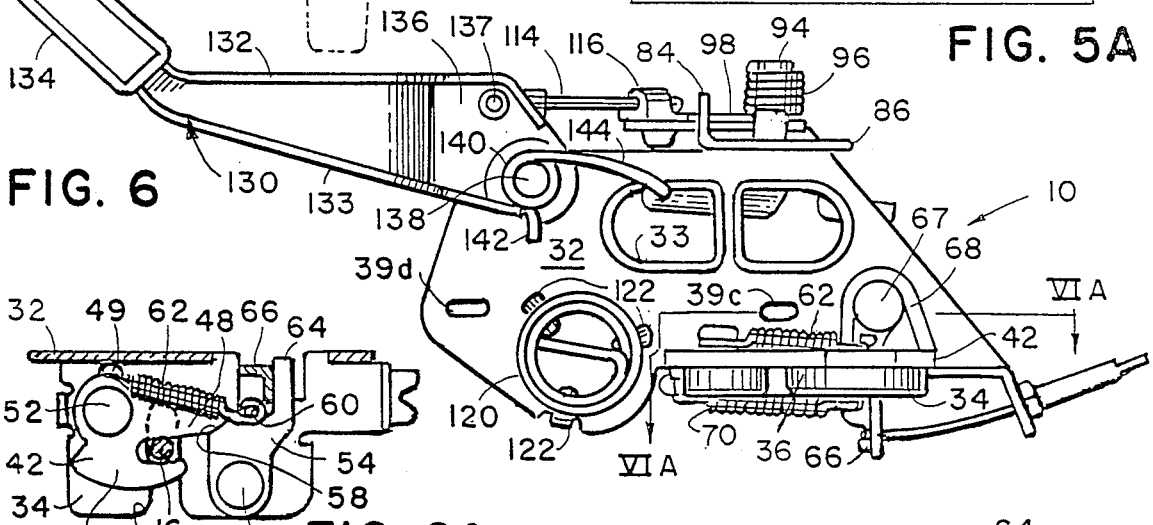
FIG. 6
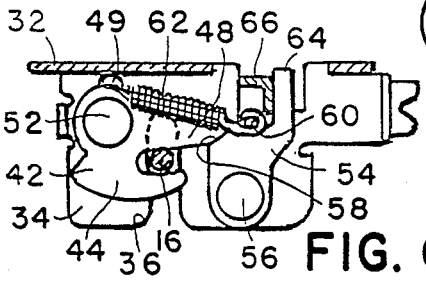
FIG. 6A
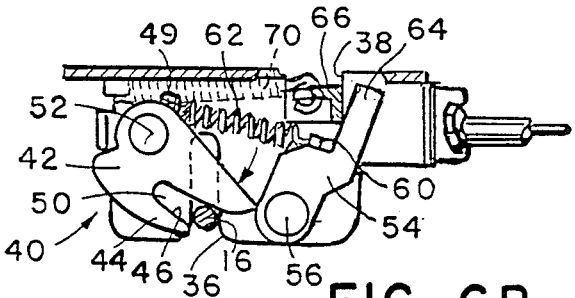
FIG. 6B
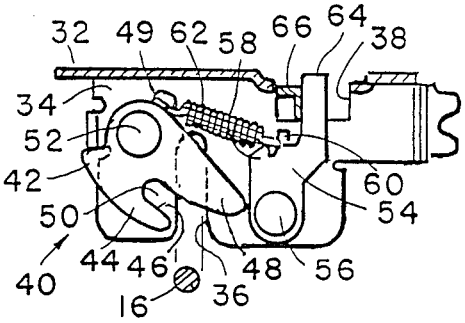
FIG. 6C FIG. 7
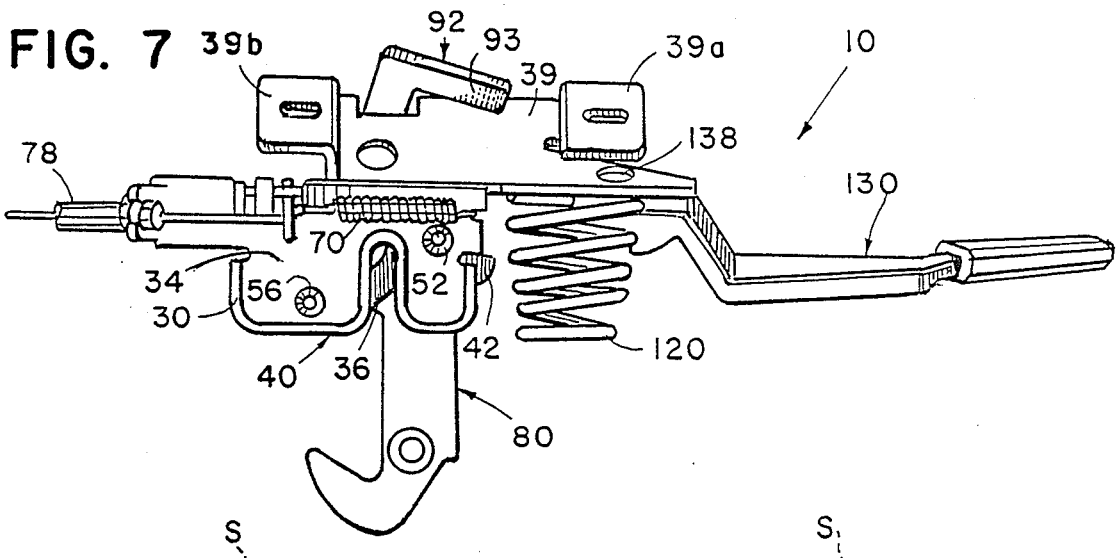
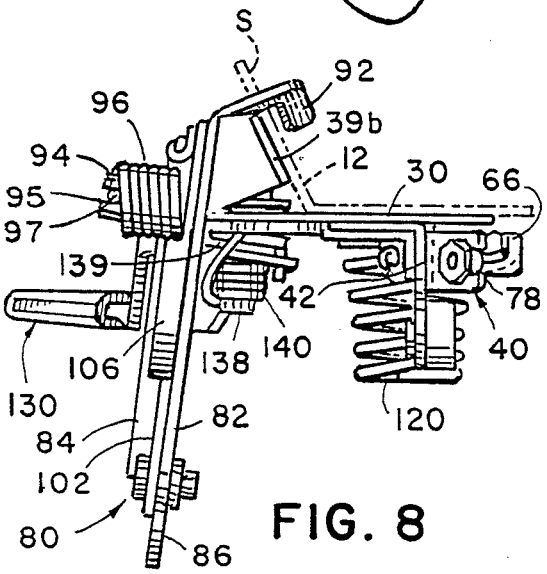
FIG. 8
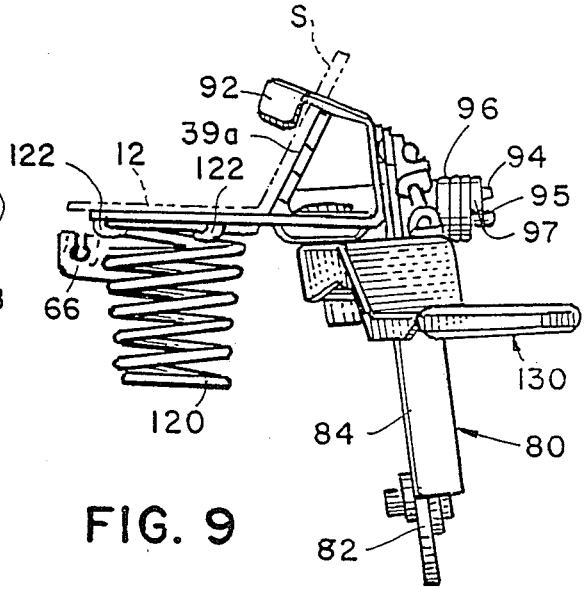
FIG. 9
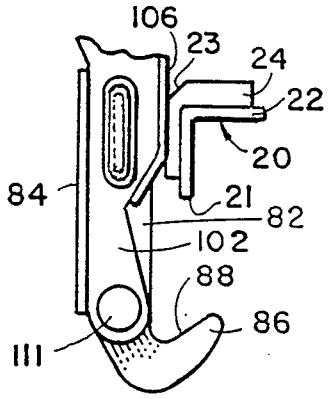
FIG. 14
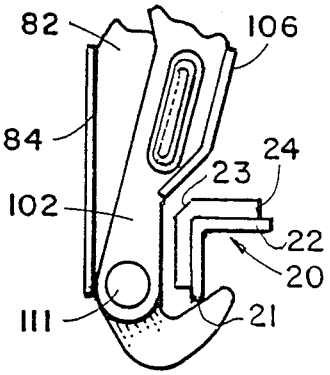
FIG. 15
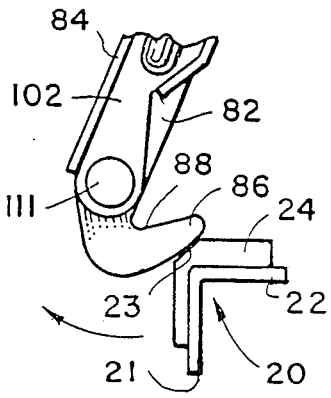
FIG. 16

FIG. 10
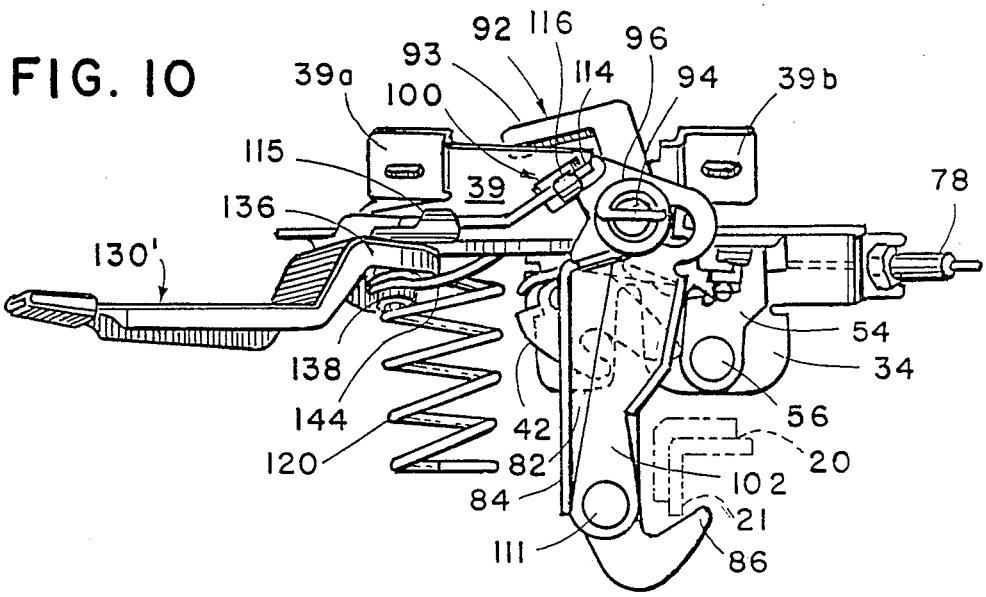
FIG. 11
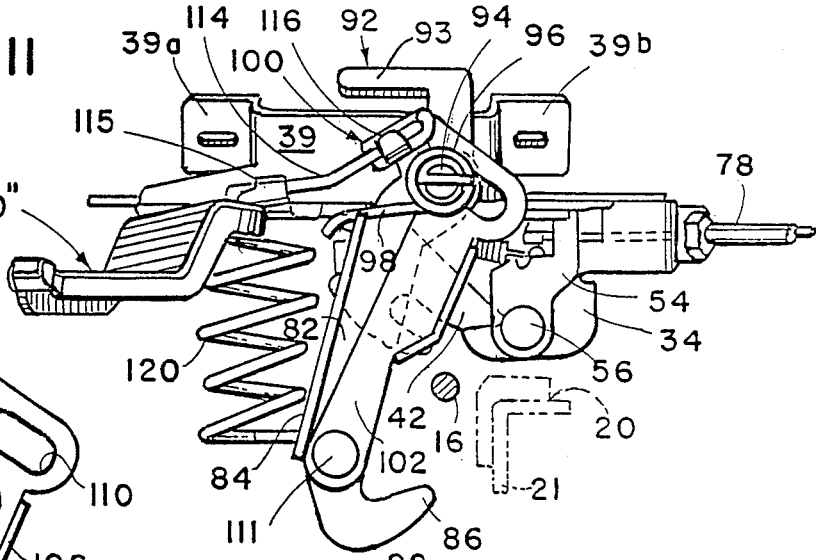
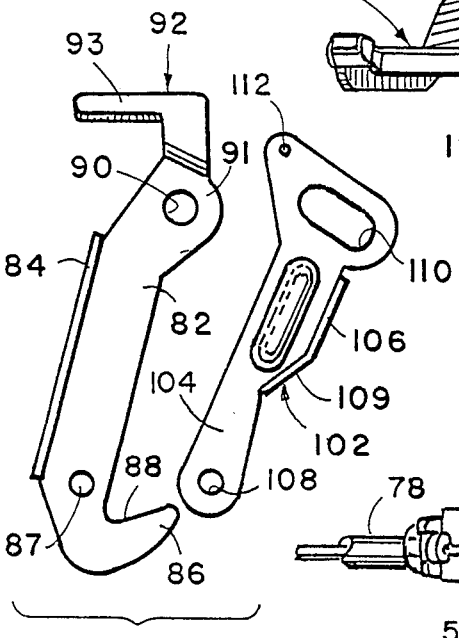
FIG. 13
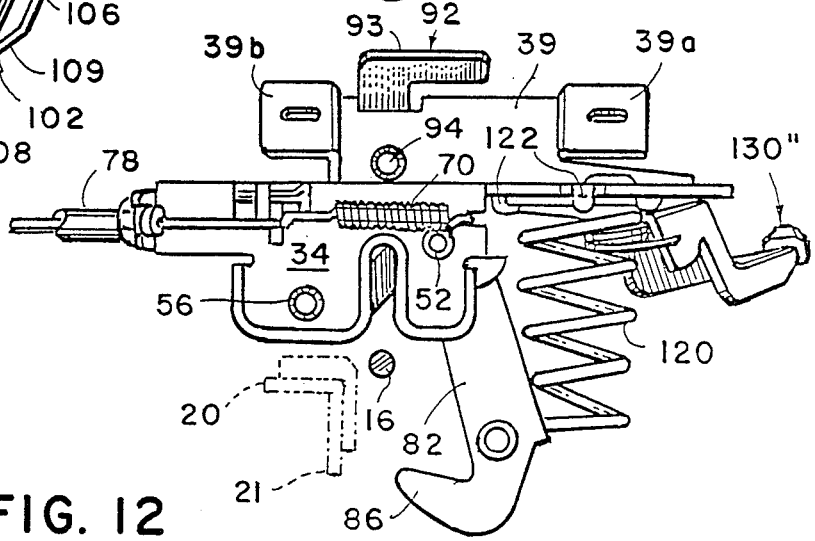
FIG. 12

FIG. 20
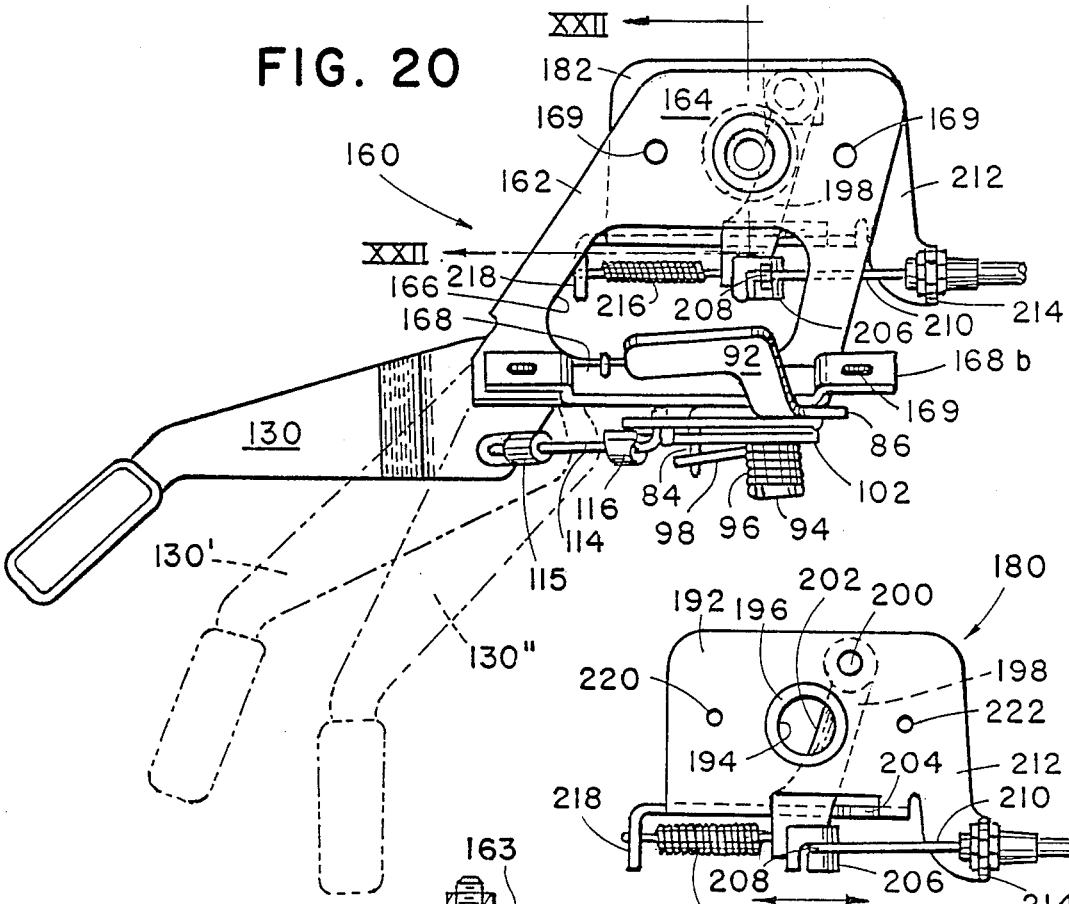
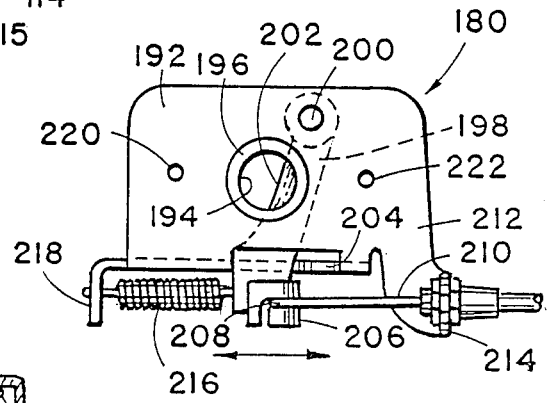
FIG. 23
FIG. 22
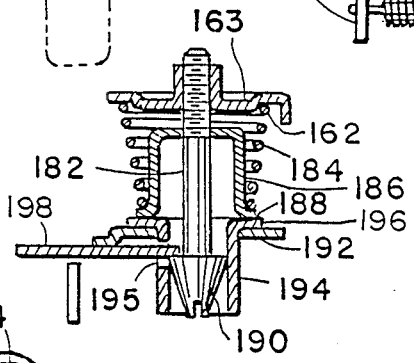
FIG. 24
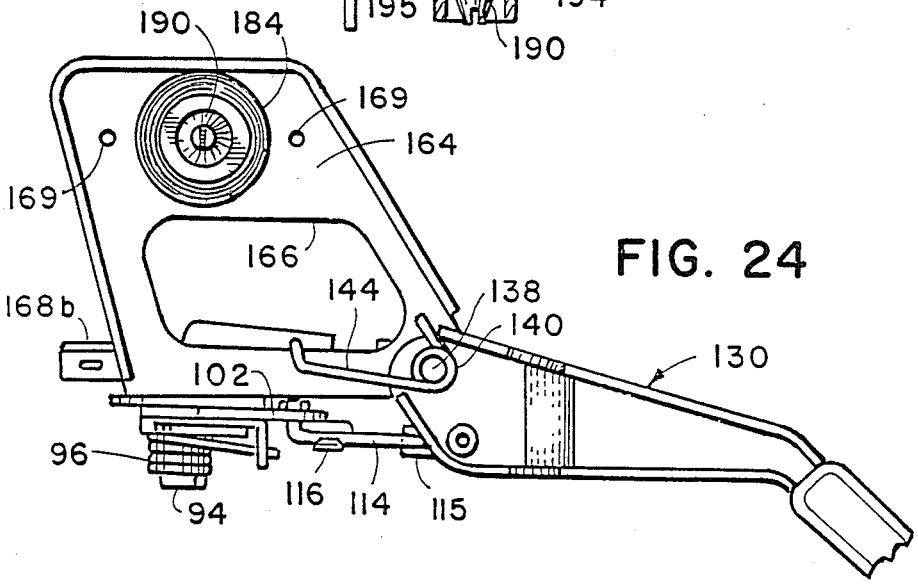

LATCH ASSEMBLY FOR VEHICLES

BACKGROUND OF THE INVENTION

This invention relates to latch assemblies used on vehicles to secure an engine hood or other pivotal member to another portion of the vehicle body. More particularly, the invention is a latch assembly especially adapted for use with pivotal engine hoods having a primary latch releasable from a remote location and a secondary latch having a release handle pivoted automatically to an exposed position outside the hood for quick, easy release of the secondary latch to allow raising of the hood from a partially open to a fully open position.

A typical vehicle hood latch assembly includes a primary latch which may be released either externally or from the interior of the vehicle as desired and a secondary or safety latch which holds the hood in partially open position after the primary latch is released. This prevents the vehicle driver's vision from being totally impaired by a completely open hood should the primary latch release or fail when the vehicle is in use. A common arrangement is to provide a release arm under the hood for operating and/or withdrawing the secondary latch to allow full opening of the hood. In most vehicles, the hood is biased upwardly by springs or the like when the primary latch is released thereby leaving a small gap or opening into which a person must extend his hand to grasp and release the secondary safety latch. Due to varying body designs, the safety latch release under the hood is not positioned in a uniform location and is often very difficult to reach. Trying to find the secondary release handle is often time consuming and frustrating, especially at night or when the vehicle operator is unfamiliar with the vehicle. One's hand can even be scratched, injured or soiled by reaching under the hood to release the safety latch.

One proposed solution to the above problems is the provision of a release rod on a secondary safety latch such as that shown in U.S. Pat. No. 3,966,244 to Kleisser et al. Such release lever is pivotally mounted to a secondary safety latch such that when the hood is partially raised, the rod is projected straight out through the grill of the hood toward the operator. However, such secondary latch and release rod are normally biased to a retracted position and are only extended through the grill when the secondary latch is engaged with a keeper member on the vehicle. Since the secondary latch and rod are always biased to a retracted position, the rod is pushed rapidly outwardly from its retracted position when the hood is slammed closed. This could cause an operator having his hand over the grill to be struck by the rod as it is projected rapidly outwardly by the slamming of the hood. Since an operator may have no warning as to the presence of the release lever which is normally retracted, such rapid projection upon slamming of the hood could, in some cases, cause injury. Moreover, the release rod of U.S. Pat. No. 3,966,244 must be guided by the grill structure of the vehicle thereby making installation on hoods without attached grills difficult and/or requiring additional support.

Another problem with prior known latch assemblies for vehicles is that of failure and release of the hood to a completely open position while driving if the fasteners for the assembly should unintentionally loosen or fail during use. Even though conventional latch assemblies typically provide both primary and secondary latches, should the fasteners fail, neither latch assembly would be operable thereby completely releasing the hood and possibly totally obscuring the driver's vision when wind pressure on the vehicle could force the hood open.

Yet another problem is the fact that many conventional latch assemblies require installation of parts on both the pivotal member or hood and the lower body portion for proper operation to hold the hood closed. Such separate assembly requires significant installation time and causes the assembly to be more expensive to manufacture and use. Such arrangements also require additional preparation of areas receiving the latch assembly on the vehicle again adding to the overall cost of use.

The present invention provides a solution to these and other problems encountered with prior known latch assemblies for engine hoods or other pivotal members on vehicles.

SUMMARY OF THE INVENTION

Accordingly, the present invention provides a latch assembly including a movable handle which is automatically moved into the gap between the engine hood or other pivotal member of the vehicle on which the latch assembly is mounted and a fixed vehicle portion when a primary latch is released. The movable handle enables release of a secondary latch to fully open the pivotal member. Since the movable handle is fully exposed outside the hood after the primary latch is released, the operator need not search under the hood for the secondary latch release and can quickly and easily completely release the hood to its fully open position.

The present invention also provides a safety retainer on the latch assembly for engaging a portion of the hood, pivotal member or fixed vehicle portion to which the assembly is secured should the latch fastening means become loose or fail. The hood or pivotal member will be maintained at least partially closed in such event. Further, in one embodiment, the present invention provides a unitary assembly with all parts on a single mounting plate allowing installation in a single operation to one or the other of the pivotal member or fixed vehicle portion.

In one form, the invention is a latch assembly for securing a pivotal member on a vehicle to a fixed portion of the vehicle, the pivotal member being of the type movable between open and closed positions to define a gap between the edge of that pivotal member and the fixed vehicle portion when the pivotal member is in the open position. The assembly includes a primary latch for mounting on one of the pivotal member or fixed vehicle portion and movable between a latched position for retaining a striker member on the other of the pivotal member and fixed vehicle portion and an unlatched position for releasing the striker member. A secondary latch is also provided and adapted for mounting on one of the pivotal member and fixed vehicle portion and movable between a latched position for holding the pivotal member partially open when the primary latch means is unlatched and released and an unlatched position allowing the pivotal member to be fully opened. Movable handle means for moving the secondary latch between latched and unlatched positions are included along with mounting means for mounting the movable handle on the same pivotal member or fixed vehicle portion on which the secondary latch is mounted. The mounting means move the handle from a first position in which it is withdrawn from the gap between the pivotal member and fixed vehicle portion into a second position in the gap when the primary latch means is unlatched and released. Thus, the handle means is positioned for easy access in the gap to move the secondary latch to its unlatched position to fully open the pivotal member after the primary latch is released.

In preferred forms of the invention, the handle for releasing the secondary latch is pivotally mounted to swing into the gap generally parallel to an edge of the pivotal member or fixed vehicle portion on which it is mounted. The primary latch may be mounted on either the pivotal member or fixed vehicle portion and includes releasable means controlled from a remote position. Also, the handle may be connected to the secondary latch by a lost motion linkage assembly allowing the handle to move to its exposed position before the secondary latch is released.

In another form of the invention, the latch assembly includes primary latch means for engaging and releasing a striker member, secondary latch means on a mounting plate for engaging and releasing a keeper on the vehicle to hold the pivotal member in partially open position after the primary latch has been released, and fastening means for securing the mounting plate to one of the pivotal member and fixed vehicle portions. Safety retaining means are also included for engaging a portion of the pivotal member or fixed vehicle portion to which the mounting plate is secured when the fastening means are loose or released whereby the pivotal member will be maintained in at least a partially closed position even if the fastening means are loose or accidentally fail.

The invention provides numerous advantages over prior known vehicle latch assemblies. A secondary latch holds the hood partially open after release of the primary latch until the hood is released to a fully open position by an easily accessible, protruding handle in the gap between the hood and surrounding vehicle portion. The handle may be colored for high visibility, is automatically extended when the primary latch is released, is automatically retracted when the pivotal member or hood is closed and the primary latch is latched, and is movable to a third position to easily release the secondary latch to fully open the hood after the primary latch is released. Also, in one form, the latch assembly is completely mounted on a single plate for simplified manufacture, installation and repair on the vehicle. Further, in that same form, the assembly is light in weight and compact enabling complete mounting on a hood, trunk cover or other pivotal member on a vehicle without requiring piecemeal assembly on opposing vehicle portions. Moreover, the assembly provides additional safety beyond the primary and secondary latches by preventing the hood or other pivotal member from opening should the latch assembly fasteners fail or loosen via a tertiary safety retaining arm which engages the sheet metal or other vehicle portions.

These and other objects, advantages, purposes and features of the invention will become more apparent from a study of the following description taken in conjunction with the drawings.

BRIEF DESCRIPTION OF THE DRAWINGS

FIG. 1 is a perspective view of the front of a vehicle incorporating a first embodiment of the latch assembly of the present invention on a pivotal engine hood wherein the hood is partially opened and the secondary latch release arm is pivoted into the gap between the hood and the lower vehicle body portion;

FIG. 2 is a fragmentary, perspective view of the hood of the vehicle in FIG. 1 when further opened and illustrating the first embodiment of the latch assembly and the striker member and keeper member portions on the lower vehicle body;

FIG. 3 is a fragmentary, perspective view of the striker member and keeper members adapted for engagement with the first embodiment of the latch assembly;

FIG. 4 is a front elevation of the first embodiment of the latch assembly;

FIG. 4A is a side sectional view of the secondary latch assembly taken along line IVA—IVA of FIG. 4;

FIG. 5 is a top plan view of the latch assembly shown in FIG. 4;

FIG. 5A is a fragmentary, top plan view illustrating the primary latch release lever of FIGS. 4 and 5;

FIG. 6 is a bottom plan view of the latch assembly of FIGS. 4 and 5;

FIG. 6A is a fragmentary, front elevation of the primary latch subassembly of FIGS. 4 and 5 in latched position in the present latch assembly;

FIG. 6B is a fragmentary, front elevation of the primary latch subassembly when released with the primary latch release lever pivoted as shown in FIG. 5A;

FIG. 6C is a fragmentary, front elevation of the primary latch subassembly with the primary latch member fully released and the release lever returned to its first position;

FIG. 7 is a rear elevation of the latch assembly of FIGS. 4, 5 and 6;

FIG. 8 is a right end elevation of the latch assembly of FIGS. 4–7;

FIG. 9 is a left end elevation of the latch assembly of FIGS. 4–8;

FIG. 10 is a front elevation of the latch assembly of FIGS. 4–9 with the primary latch member released and the secondary latch release arm swung to its accessible position;

FIG. 11 is a front elevation of the latch assembly of FIGS. 4–9 with the primary latch member released and the secondary latch release arm pivoted to its third position when moving the secondary latch to its unlatched position;

FIG. 12 is a rear elevation of the latch assembly with the secondary latch release arm pivoted to the position shown in FIG. 11;

FIG. 13 is a front elevation of the secondary latch arm and pivotable latch lever for the secondary latch arm;

FIG. 14 is a fragmentary, front elevation of the secondary latch arm when the hood is fully closed and the primary latch is latched;

FIG. 15 is a fragmentary, front elevation of the secondary latch arm when the primary latch is released and the secondary latch is in latched position;

FIG. 16 is a fragmentary, front elevation of the secondary latch arm during closing of the hood or pivotal member;

FIG. 20 is a top plan view of the latch assembly shown in FIG. 19;

FIG. 22 is a side section of the primary latch securing stud or striker of the upper latch assembly taken along line XXII—XXII of FIG. 20;

FIG. 23 is a top plan view of the lower latch assembly of the latch assembly of FIGS. 19–21; and FIG. 24 is a bottom plan view of the upper latch assembly of FIGS. 19–21.

DESCRIPTION OF THE PREFERRED EMBODIMENTS

First Embodiment

Figure 17:
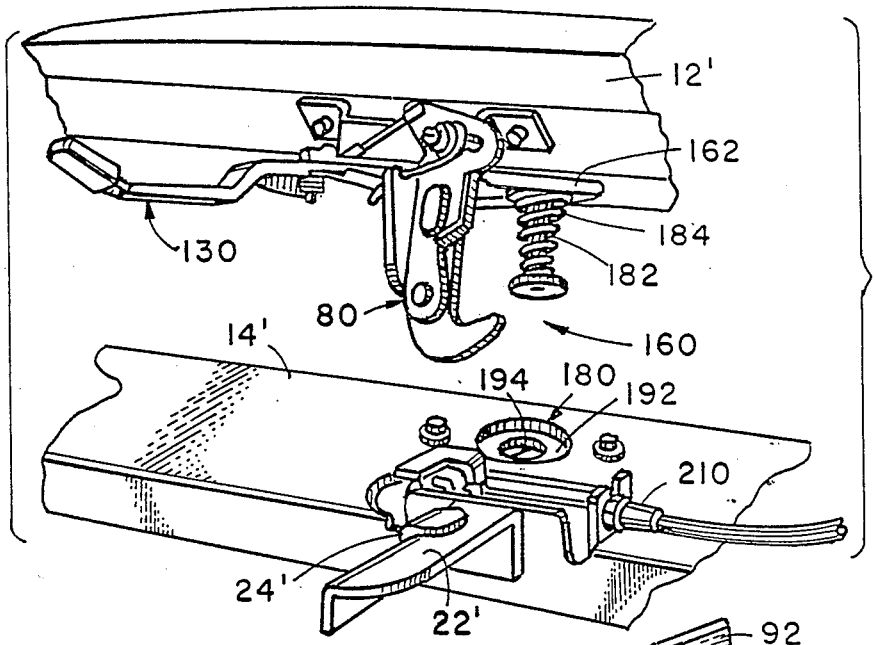
FIG. 17 is a fragmentary, perspective view of a vehicle incorporating a second embodiment of the latch assembly of the present invention on a pivotal engine hood with the hood partially opened and the secondary latch release arm pivoted into the gap between the hood and the lower vehicle body portion.

Referring now to the drawings in greater detail, FIGS. 1–9 illustrate a first embodiment 10 of the latch assembly for vehicles of the present invention. As shown in FIGS. 1–3, latch assembly 10 is adapted to be used with an engine hood 12, trunk lid or other pivotal member which is hingedly mounted or otherwise pivotally movable between opened and closed positions with respect to fixed portions of a vehicle such as the front cowling and fender areas around the hood. Latch assembly 10 may be mounted entirely either on the pivotal member or hood 12 or on other structural supports such as supports 14 inside the engine compartment adjacent the front cowling of the vehicle.

As shown in FIGS. 1 and 2, latch assembly 10 is previously assembled as a complete unit and mounted on the underside of pivotal hood 12 and is adapted to engage a striker rod or member 16 and a secondary keeper member 20 spaced in front of the striker member 16 and slightly to one side. Striker 16 is mounted on support 14 over a hole or aperture 18 in that cowling support. As shown in FIGS. 14–16, keeper member 20 includes a metal angle 22 and a resilient, low friction, nylon or other polymeric pad 24 having an L shape and secured to the top and side surfaces of angle 22 for engagement with portions of the latch assembly as described more fully below. Cowling support 14 also includes a circular depression or recess 26 immediately adjacent aperture 18 and striker member 16 for receiving and locating a coil spring 120 from the latch assembly which biases the hood or pivotal member 12 to a partially open position as shown in FIGS. 1 and 2. Striker member 16 and aperture 18 are designed to receive and engage a primary latch 40 on latch assembly 10 while keeper member 20 is adapted to engage a secondary latch 80 on the latch assembly as described more fully below.

As shown in FIGS. 4, 5 and 6, latch assembly 10 includes a stamped, sheet metal mounting plate 30 having a primary latch subassembly 40 at the rear of the mounting plate, a secondary latch subassembly 80 at the front of the mounting plate, a coil biasing spring 120 for urging the hood or other pivotal member on the vehicle to a partially opened position, and a movable, swing-out pivot handle 130 connected to secondary latch subassembly 80 for moving the secondary latch from its latched to its unlatched position to fully open the hood or other pivotal member. The latch assembly also includes a safety retaining arm 92 (FIGS. 4 and 5) for retaining the hood or other pivotal member in partially closed position even if the securing members or fasteners for holding the latch assembly 10 to the vehicle accidentally become loose or fail.

As shown in FIG. 5 and as described below, movable handle 130 is biased from a first retracted or withdrawn position (solid lines) to a second, accessible position 130′ in the gap between the partially opened hood and the fixed vehicle front cowling as soon as primary latch 40 is released. Handle 130 may be moved manually to a third position 130″ shown in FIG. 5 to release secondary latch subassembly 80 from keeper 20 as shown in FIGS. 11–12 to allow hood 12 to be pivoted to its fully opened position.

Referring now to FIGS. 4–9, mounting plate 30 includes a generally planar base 32 and a downwardly extending rear flange 34 having a striker receiving recess 6 extending thereinto from the edge of flange 34. Pivotally mounted adjacent recess 36 on a rivet or other fastener 52 is a generally C-shaped, sheet metal, primary latch member 42 (FIGS. 6A, 6B, 6C) having a keeper flange 44 with a keeper surface 46 extending therealong and a return flange 48 spaced from keeper flange 44 by a striker member receiving slot or recess 50. Keeper flange 44 and return flange 48 pivot across the full width of striker recess 36 in the manner shown in FIGS. 6A, 6B and 6C.

Pivotal movement of primary latch member 42 is controlled by latch pawl 54 which is pivotally secured to mounting plate flange 34 on the opposite side of striker recess 36 from the primary latch member. Latch pawl 54 includes a slanted retaining surface 58 for engaging the end of return flange 48 to hold pivotal latch member 42 in its latched position unless the latch pawl is pivoted away from the primary latch member. Latch pawl 54 also includes a spring flange 60 for engaging one end of coil spring 62 extended between flange 60 and spring retainer 49 on primary latch member 42. Since spring 62 is constantly in tension, pivotal movement of latch pawl 54 away from primary latch member 42 stretches that spring and urges primary latch member 42 in a clockwise direction to its unlatched position as shown in FIGS. 6A, 6B and 6C.

Movement of latch pawl 54 away from the latch member for release is provided by engagement of upstanding release flange 64 with a release lever 66 pivotally mounted in recessed area 68 in base 32 of mounting plate 30 by a rivet 67 or other cylindrical fastener. Release lever 66 is biased to a first unreleased position as shown in FIGS. 4, 5, 6, 6A and 6C by a coil tension spring 70 stretched between aperture 72 in release lever 66 and a spring flange 74 on mounting plate 30 spaced a distance from the release lever. Tension on spring 70 biases lever 66 to the left shown in FIGS. 5, 6A and 6C within slot 38 in the mounting plate. Release lever 66 is adapted to be controlled from a remote location within the passenger compartment of the vehicle on which latch assembly 10 is mounted by a Bowden-type cable assembly 78 (FIGS. 4–7). The cable from assembly 78 is crimped or engaged around notch 76 in releas lever 66 such that when the cable is withdrawn, release lever 66 is pivoted to the right as shown in FIG. 5A against the biasing force of coil spring 70. Such movement pivots latch pawl 54 in a clockwise direction against the biasing force of coil spring 62 such that retaining surface 58 on the latch pawl is pulled away from return flange 48 on the primary latch member. The pivotal movement of the latch pawl also stretches coil spring 62 to provide a greater biasing force to positively urge primary latch member 42 in the clockwise direction as shown in FIG. 6B. Such pivotal movement of the primary latch member, coupled with the upwardly biased motion of the vehicle hood itself, allows striker member 16 to slide downwardly in striker recess 36 as keeper flange 44 is pivoted away from the striker member. Hence, movement of release lever 66 to the right as shown in FIG. 5A releases the primary latch member from its latched position shown in FIG. 6A to its unlatched position shown in FIG. 6C upon actuation and withdrawal of the cable in assembly 78.

Once primary latch subassembly 40 has been released, secondary latch subassembly 80 retains hood 12 in a partially open position which is created by the biasing force of coil spring 120 extending to its uncompressed state against depression 26 in cowling support 14 as shown in FIG. 1. Secondary latch assembly 80 includes a generally J-shaped, stamped, sheet metal secondary latch arm 82 best seen in FIG. 13. Secondary latch arm 82 includes an upturned flange 84 along one edge, a curved nose portion 86 defining a detent or recess 88 for engaging keeper member 20, and a circular aperture 90 for pivotally mounting the latch arm on upwardly extending flange 39 at the front of mounting plate 30. Extending upwardly at an angle from upper end 91 of secondary latch arm 82 is an L-shaped, safety retaining arm 92 which is adapted to retain the hood in at least a partially closed position even if the fasteners for the assembly fail or become loose.

Secondary latch arm 82 is pivotally secured to flange 39 by a rivet or other fastener 94 at a position substantially above and aligned with striker member receiving recess 36 such that the latch arm is pivotable between a generally upright, latched position shown in FIGS. 4, 7 and 10 and an angled, unlatched position shown in FIGS. 11 and 12. As shown in FIG. 4A, fastener 94 has a stepped configuration including a cylindrical body **94*a*, circular flange 94*b* and successively reduced diameter sections 94*c*, 94*d* and 94*e*. Section 94*e* is formed into an enlarged head 94*f* to retain the fastener on flange 39. Section 94*d* engages against flange 39 to provide space for pivotal movement of arm 82 on section 94*d*. Section 94*e* has a flat side corresponding to a noncircular aperture in flange 39 to prevent fastener 94 from rotating with arm 82. Section 94*c* engages arm end 91 around aperture 90 to provide space between arm 82 and flange 94*b* for pivotal movement of latch lever 102** as described below.

Latch arm 82 is biased toward its latched, upright position by a coil spring 96 fitted over body portion **94*a* of fastener 94. Spring 96 has an extending spring arm 98 engaging the top of flange 84 at a position spaced from the pivot axis of fastener 94 to urge the secondary latch arm 82 in a counterclockwise direction toward its latched position. The end 97 of spring 96 engages a slot 95 in the end of fastener 94 (FIGS. 4, 4A, 8 and 9) to prevent the spring from rotating. Although safety retaining arm 92 pivots with secondary latch arm 82 as shown in FIGS. 4, 7 and 10–12, flange 93 of arm 92 is spaced from and behind the sheet metal of the hood or other pivotal member 12 as shown in FIGS. 8 and 9** to allow such pivotal movement yet retain the latch assembly in position should the fasteners fail.

Referring now to FIGS. 4–6 and 10–13, a pivotable, swing-out handle 130 is provided along with a lost motion assembly 100 forming part of the secondary latch assembly to enable movement of the secondary latch arm 82 from its latched to its unlatched position through pivotal movement of handle 130.

As shown in FIGS. 4–6, swing-out handle 130 includes a handle body 132 and an outwardly extending, angled end 134 covered with a brightly colored polymeric cap or grip for easy visibility and grasping. The end 136 of handle 130 opposite free end 134 is angled upwardly and includes a circular aperture through which a rivet or cylindrical post 138 or other cylindrical fastener is received to pivotally secure the entire handle to the underside of base 32 of mounting plate 30. A coil torsion spring 140 (FIGS. 4, 6 and 8) is received around fastener 138 beneath the handle and includes one end 142 engaging a downturned flange 133 on handle body 132 and a second end 144 clipped over the edge of aperture 33 in base 32 of mounting plate 30. Nylon washers (not shown) may be included between handle end 136 and the underside of base 32 and between flange 139 on fastener 138 (FIG. 8) and the underside of arm end 136 as bearings. Accordingly, the tension and biasing force of spring 140 urges handle 130 outwardly of the latch assembly, i.e., counterclockwise in FIG. 5, such that the handle is automatically extended to its accessible position 130' when lost motion connecting assembly 100 is released as described below.

As shown in FIGS. 4, 10, 11 and 13, lost motion assembly 100 includes a pivotable latch lever 102 having a substantially rectilinear body portion 104 with an upturned flange on one edge 106, a pivot aperture 108 at its bottom end, and an elongated, transverse aperture 110 at its upper free end. Latch lever 102 is pivotally secured to the lower end of secondary latch arm 82 with a rivet 111 or other fastener received through aperture 108 and a similar circular aperture 87 adjacent the lower end of latch arm 82. Pivotal movement of the latch lever 102 is guided by a rivet or other fastener 94 which pivotally secures latch arm 82 to flange 39 of mounting plate 30 and extends through elongated aperture 110 at the upper end of the latch lever. As will be understood from comparing FIGS. 4, 10 and 11, latch lever 102 is pivotable about fastener 111 between a first position (FIG. 4) in which fastener 94 is engaged with the right end of elongated aperture 110 and a second position (FIG. 10) in which latch lever 102 is pivoted clockwise such that fastener 94 is received against the left end of aperture 110. Such pivotal movement is caused by the connection of handle 130 to the upper end of latch lever 102 by a bent connecting rod or link 114 (FIGS. 4–6, 10 and 11) which is pivotally connected between aperture 137 in end 136 of handle 130 and aperture 112 at the upper end of latch lever 102. Those pivotal connections are made via polymeric pivotal connectors 115, 116 received in apertures 137, 112 which clip and hold the ends of cylindrical rod 114 in those apertures as shown in FIGS. 4 and 6.

As will now be understood from FIGS. 4–6, 10 and 11, when pivot lever 102 is held in its first or left position as shown in FIG. 4, link 114 is held in its leftwardmost position causing handle 130 to be pivoted to its withdrawn or retracted position, i.e., clockwise, in FIG. 5 (solid lines). In such position, latch assembly 10 and hood 12 are in their completely closed position. When primary latch 40 is released and hood 12 is partially opened, latch lever 102 is moved away from keeper pad 24 and is thereby released. The biasing force of coil spring 140 then rotates handle 130 to its second or accessible position 130' (FIG. 5) causing latch lever 102 to move to its second position via link 114. As described below, in such position, and depending on the uncompressed length of coil spring 120, secondary latch arm 82 either engages keeper 20 or is positioned immediately below keeper 20 to hold hood 12 in its partially open position. Should full opening of the hood be desired, end 134 of handle 130 may be grasped and pivoted further counterclockwise to position 130'' (FIG. 5) causing latch lever 102 and latch arm 82 to be pivoted in unison via link 114 to the unlatched position of the secondary latch assembly (FIG. 11) since link 114 urges latch lever 102 against the left end of aperture 110 producing torque via fastener 111 to cause clockwise rotation of secondary latch arm 82 about fastener 94. When manual counterclockwise pressure against handle end 134 is released, the biasing force of coil spring 96 on fastener 94 urges secondary latch arm 82, and latch lever 102 carried thereon, back to the latched position of the secondary latch assembly (FIG. 10) thereby automatically returning handle 130 to its second or intermediate position 130'. When hood 12 is completely closed again, latch lever 102 will be urged counterclockwise by pad 24 of keeper 20 to return handle 130 to its first position against the biasing force of spring 140.

Referring now to FIGS. 4, 7–9 and 12, coil biasing spring 120 is secured to the underside of base 32 of mounting plate 30 by three bent tabs 122. The entire mounting plate 30 with all subassemblies secured thereon including primary latch assembly 40, secondary latch assembly 80, handle 130, lost motion assembly 100 and coil spring 120 may be secured as a single unit to the vehicle either on the underside of hood 12 or another pivotal member or to the fixed portion of the vehicle by means of mounting flanges **39*a*, 39*b* and securing apertures 39*c* and 39*d* (FIGS. 4, 6 and 7–9). Installation and removal for repair is thus significantly simplified by the use of four fastening bolts or other fasteners received in those areas without the necessity of separately assembling each of the parts individually. After assembly to the underside of hood 12 as shown in FIGS. 8 and 9, the cable assembly 78 may be secured to release lever 66 and the latch assembly is ready for use. As will be noted from FIGS. 8 and 9, the sheet metal S on the underside of the hood is received between flanges 39*a*, 39*b* and flange 93 of safety retaining arm 92. Should those fasteners or bolts in the fastening areas 39*a–d* loosen, fail or drop out, hood 12 including sheet metal S would pivot upwardly due to the biasing force of spring 120 until arm 92 engaged sheet metal S and retaining nose 86 engaged keeper 20. Hood 1 would thus open no further than the distance between arm 92 and retaining nose 86 on latch arm 82**. Hence, even if the designed fastening system should fail, the hood will be retained in partially closed condition for proper viewing by the vehicle driver.

Operation of the latch assembly will now be understood. When hood 12 or other pivotal member on the vehicle is fully closed, latch assembly 10 is positioned such that fastener 94 and recess 36 are aligned with one another and with the centerline of hood 12 as shown in FIGS. 4–6, 6A, 7–9 and 14. Such positioning prevents hood 12 from twisting about its centerline when the primary or secondary latch is engaged. In this position, handle 130 is retracted or withdrawn to the position shown in solid lines in FIGS. 4–6, primary latch member 42 is in its latched position as shown in FIG. 6A, and secondary latch assembly 80 is in its latched position as shown in FIG. 14 with latched lever 102 urged to its first or left position by contact with the side surface of polymeric pad 24 on keeper 20. As above, when latch lever 102 is urged to its first position by such contact, link 114 forces handle 130 to its first or retracted position against the biasing force of coil spring 140.

To open the hood, cable assembly 78 is pulled from inside the vehicle, thereby rotating release lever 66 to the right in FIG. 5 and simultaneously pivoting latch pawl 54 to the right and releasing return flange 48 of latch member 42 as shown in FIG. 6B. Latch member 42 pivots in a clockwise direction releasing striker 16. When primary latch member 40 is released, spring 120 urges hood 12 upwardly with arm 82 moving parallel to but out of contact with keeper 20 until nose 86 either engages keeper edge 21 as shown in FIG. 15 or is positioned immediately below keeper edge 21. The distance which hood 12 moves upwardly is governed by the uncompressed length of spring 120. Spring 120 has a length at least long enough to move latch lever flange 106 out of contact with pad 24. Hood 12 thus opens and is held in its partially opened position under the biasing force of coil spring 120 pushing against cowl support 14 in depression 26. When cable assembly 78 is released from inside the vehicle, release lever 66 is returned to its start position by spring 70 causing latch pawl 54 to be rotated counterclockwise to its first position against release lever 66 by spring 62.

Simultaneously, as pivot member or hood 12 rises to its partially open position, the contact between the side of flange 106 on latch lever 102 and polymeric pad 24 on keeper 20 is released allowing latch lever 102 to pivot to its second position in a clockwise direction under the biasing force of spring 140 and link 114 as shown in FIGS. 10 and 15. Thus, as soon as contact ends between keeper pad 24 and latch lever 102, handle 130 is automatically pivoted outwardly in a direction or plane generally parallel to the edge of hood 12 by spring 140 to its second or accessible position 130'. Brightly colored handle end 134 is then easily accessible outside the edge of hood 12 in the gap between the hood and the fixed vehicle front cowling portion (FIGS. 1 and 2).

Movement of hood 12 to its fully open position is accomplished by grasping handle end 134 and rotating it in a further counterclockwise motion to position 130'' (FIG. 5). This forces link 114 to the right and pivots both secondary latch arm 82 and latch lever 102 clockwise about pivot 94 against the force of spring 96 and spring arm 98. Secondary latch assembly 80 is thus moved from its latched position (FIG. 10) to its unlatched position (FIG. 11) as handle 130 is moved between positions 130' and 130''. Retaining nose 86 is thus moved from under bottom edge 21 of keeper 20 to the side of the keeper such that the keeper is no longer positioned to engage or engages detent 88 (FIGS. 11 and 12). Hood or pivotal member 12 may thus be fully opened manually. After release of handle 134 during full opening of the hood, spring 96 and spring arm 98 return secondary latch arm 82 and latch lever 102 in a counterclockwise pivotal direction around pivot 94 to the latched position of the secondary latch assembly. This forces link 114 to the left in FIGS. 4–6 and automatically returns handle 130 to position 130'. Immediately prior to closing the hood, therefore, primary latch member 42, latch pawl 54 and release lever 66 are positioned as shown in FIG. 6C while secondary latch assembly 80 is positioned as shown in FIG. 10 with handle 130 in position 130'.

Upon closing of the hood or pivotal member 12, latch assembly 10 is swung downwardly such that the curved undersurface 89 of retaining nose 86 on latch arm 82 engages the beveled surface of keeper pad 24 as shown in FIG. 16. Secondary latch assembly 80 is thus cammed clockwise about pivot 94 with handle 130 automatically following from position 130' to position 130" via link 114. As hood 12 continues downwardly, beveled surface 109 of flange 106 engages the beveled surface 23 of keeper pad 24 and begins pivoting latch lever 102 counterclockwise to the left. Simultaneously, striker member 16 engages the edge of return flange 48 of primary latch member 42 and begins rotating primary latch member 42 counterclockwise. Such motion rotates latch pawl 54 clockwise providing space for the return of flange 48 and primary latch member 42 to its latched position as the hood continues down and striker member 16 is urged upwardly against flange 48. As hood 12 continues down to its fully closed position, striker 16 forces primary latch member 42 to the position shown in FIG. 6A and latch pawl 54 is returned to its first position (FIGS. 6A and 6C) by spring 62, lever 66 and spring 70 such that flange 46 is held by retaining surface 58 on the latch pawl. The striker 16 is thus held between flanges 44, 46 of the primary latch member to prevent the hood from opening.

Simultaneously, as hood 12 is fully closed, latch lever 102 is pivoted fully to its first position (FIG. 14) which automatically returns and retracts handle 130 to its withdrawn position under the hood such that handle end 134 is no longer accessible between the gap between hood 12 and the fixed vehicle portion Such withdrawal of the handle enables full closing of the hood and prevents the handle from being trapped between the hood and the fixed vehicle portions. As nose 86 of secondary latch arm 82 passes the end of keeper 20, spring 96 and spring arm 98 automatically rotate the latch arm to the position shown in FIGS. 14, 15 and 4 such that subsequent release of the primary latch member will allow engagement between retaining nose 86 and bottom edge 21 of keeper 20 or position the nose 86 immediately below keeper 20 to hold the hood in a partially opened position until the secondary latch assembly is again released via handle 130.

Second Embodiment

Figure 18:
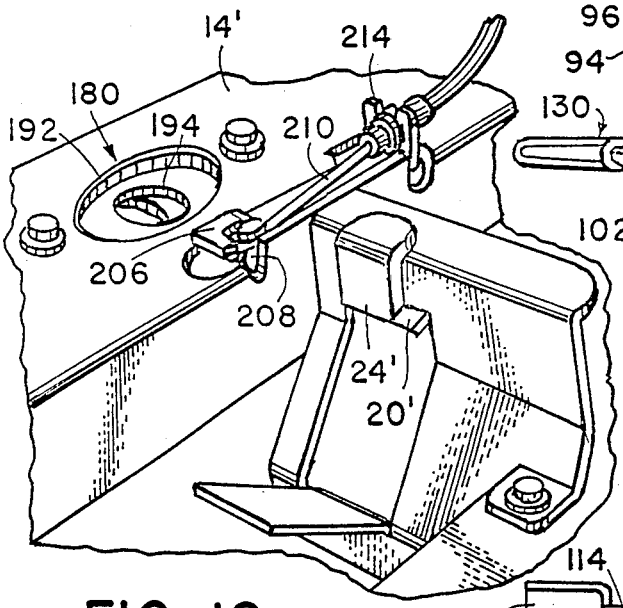
FIG. 18 is a fragmentary, perspective view of the lower latch assembly and striker member of the latch assembly of FIG. 17.
Figure 21:
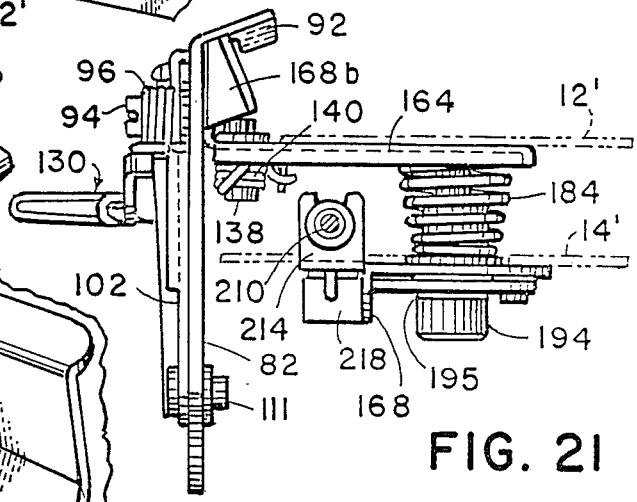
FIG. 21 is a side elevation of the latch assembly shown in FIGS. 19 and 20.
Figure 19:
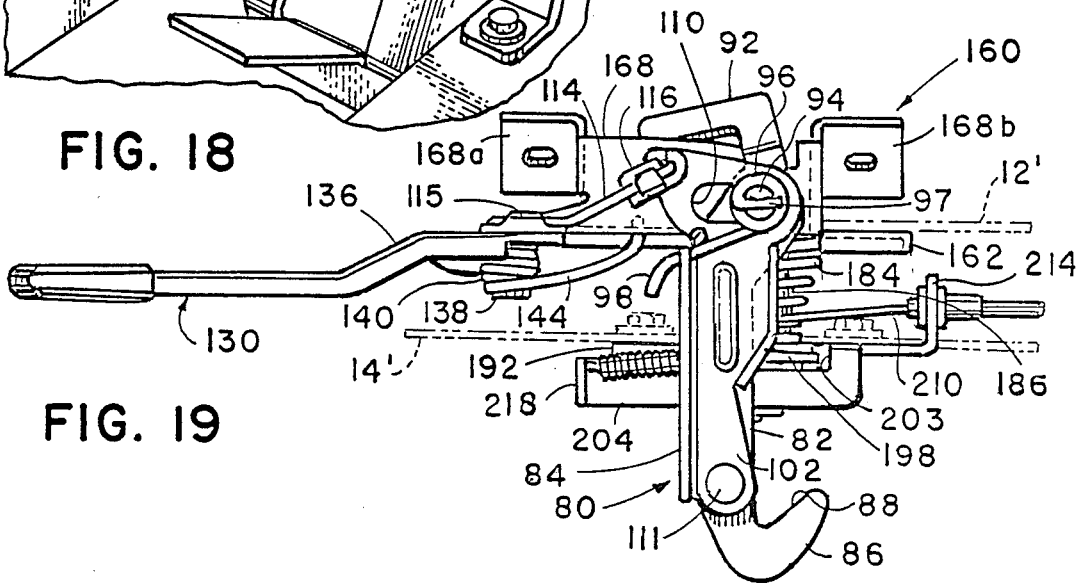
FIG. 19 is a front elevation of the second embodiment of the latch assembly shown in latched position.

Referring now to FIGS. 17–24, a second embodiment 160 of the latch assembly is illustrated. As shown in FIGS. 17 and 18, latch assembly 160, like latch assembly 10, is adapted for use with an engine hood 12', trunk lid or other pivotal member which is hingedly mounted or otherwise pivotally movable like engine hood 12. However, in embodiment 160, where like numerals indicate like parts to those in assembly 10, while the secondary latch assembly 80 and swing-out pivot handle 130 are identical with assembly 10, the primary latch assembly 180 is different and is of the plunger or spring-stud retainer type. As will be understood, latch assembly 160 includes two separate mounting plates 162 and 192 which are secured to opposing portions of the vehicle for registry with one another to allow engagement and latching of the primary and secondary latch assemblies. Either of the mounting plates 162, 192 may be mounted on the pivotal member or hood 12' or on the fixed vehicle cowling portion 14' under the hood since latch operation will be the same in either case.

As shown in FIGS. 17, 19–21 and 24, mounting plate 162 is secured to the underside of pivotal hood 12' and is stamped in one piece from sheet metal. Plate 162 includes a base 164 having aperture 166 extending therethrough and an upwardly extending flange 168 at the front edge of the plate. Fastening flanges **168*a*, 168*b* extend to either side of flange 168 and are angled forwardly to rest against the configured underside of the sheet metal hood 12'. The secondary latch subassembly 80 and swing-out pivot handle 130 are identical with those in latch assembly 10 including secondary latch arm 82 having nose 86 and detent 88 for engaging the fixed keeper 20' including polymeric pad 24' (FIG. 18), as well as latch lever 102, connecting link 114, stepped rivet or fastener 94, and coil biasing spring 96 which urges the secondary latch arm 82 to its latched position. Handle 130 and the upper end of latch lever 102 are connected by link 114 just as in latch assembly 10. Handle 130 is biased to its second, accessible position 130' by spring 140 which engages the swing-out arm at a position spaced from pivot 138 as well as engaging over the edge of aperture 166. Hence, handle 130 in embodiment 160 is movable between a withdrawn position 130, a second or accessible position 130' in which the handle extends out from under the hood in the gap between the hood 12' and the fixed vehicle cowling portion 14', and a third position 130" to which the handle is manually moved to move the secondary latch assembly 80** to its unlatched position.

The primary latch in embodiment 160 is different from primary latch assembly 40 in latch 10. Mounting plate 162 includes a downwardly projecting cylindrical stud 182 (FIGS. 21 and 22) which is threaded or otherwise secured to the underside of mounting plate 162 behind and in alignment with the pivot fastener 94 of secondary latch arm 82 on the opposite side of aperture 166. A tapered coil spring 184 is located concentrically about stud 182 under base 162 by depression 163 and engages a spring cup 186 having a lower flange 188 engaging the bottom of spring 184 to urge the cup downwardly. The free end of stud 182 terminates in a conically-shaped enlarged head 190 which serves as a stop member against which the cup 186 is forced by the biasing force of spring 184 unless the spring is compressed when the latch assembly is latched (FIG. 22). The end of spring 184 and cup 186 extend beyond the end of head 190 when the spring is uncompressed. Conical head 190 is received in the primary latch subassembly secured to the opposing portion of the vehicle below the pivotal hood 12' on plate 182 and is retained thereby until the primary latch is released.

Referring now to FIGS. 19–21 and 23, a second mounting plate 192 provides a separate and second portion of the latch assembly 160 and mounts that portion to the lower fixed vehicle cowling portion 14' under and in registry with stud 182 extending from upper mounting plate 162. Lower mounting plate 192 includes an aperture extending therethrough receiving a cylindrical cup-like socket 194 having a flange 196 which is welded to the top surface of plate 192. Socket 194, stud 182 and fastener 94 for secondary latch arm 82 are all preferably aligned with one another and with the centerline of hood 12' to prevent the hood from twisting when either latch is engaged. A primary latch release lever 198 is pivotally secured by a rivet or other fastener 200 immediately adjacent socket 194 such that one edge 202 of the release lever can pivot into and out of the interior of cup 194 through slot 195 (see FIGS. 21 and 22). Edge 202 is curved to provide more surface area over the end of head 190 for retaining purposes and to reduce the distance through which lever 198 must move to latch and release head 190. Release lever 198 extends through a slot 203 in front flange 204 extending downwardly from mounting plate 192 and includes an upstanding retaining flange 206 engaging and holding an enlarged end 208 of release cable 210 which is secured to an upstanding flange 214 spaced to one side of flange 206 on an extending portion 212 of mounting plate 192. A coil spring 216 is mounted between the free end of release lever 198 through an aperture in the lever adjacent flange 206 and a spring retaining flange 218 at the end of mounting plate 192 opposite flange 212. A pair of apertures 220, 222 spaced on either side of socket 194 in mounting plate 192 receive fasteners to secure the entire primary latch subassembly 180 on mounting plate 192 to the underside of the fixed vehicle cowling portion 14' as shown in FIGS. 18, 19, 21 and 23. Accordingly, when release cable 210 is pulled from inside the vehicle, release lever 198 is pivoted counterclockwise in FIG. 23 to pivot side 202 of lever 200 out of socket 194 thereby releasing enlarged head 190 on stud 182 such that coil spring 184 will move the stud 182 and head 190 out of socket 194 and hood 12' to its partially open position. The release cable assembly including cable 210 is secured in a fixed position on flange 214 thereby avoiding any pivoting or movement of the cable assembly which could affect its operation when hood 12' is opened and closed.

Upon release of the primary latch release lever 198 as described above, hood 12' moves to its partially open position such that secondary latch arm 82 and detent 88 on nose 86 are positioned at or immediately below the lower edge of the keeper 20' (see FIG. 15). In such position, latch lever 102 has moved out of engagement with pad 24' such that the latch lever moves clockwise to its second position under the biasing force of spring 140 through handle 130 and link 114. Hence, handle 130 is moved to its second, accessible position 130' (shown in phantom in FIG. 20). Depending on the length of stud 182 and spring 184, detent 88 will either be positioned immediately below keeper 20' or in engagement with its lower edge.

In order to fully open the hood, the now accessible handle end 134 of handle 130 is grasped and moved to its third position 130'' thereby pivoting latch lever 102 and secondary latch arm 82 in unison to the unlatched position of the secondary latch such that nose 82 is moved away from keeper 20'. Hood 12' may then be moved upwardly to its fully open position.

Upon closing hood 12', secondary latch arm 82 engages pad 24' to allow the hood to return to its partially open position. Such engagement causes camming of the secondary latch arm 82 in a clockwise direction thereby moving handle 130 from its second position 130' to its third position 130'' until secondary latch arm 82 moves past the keeper 20' and is returned via the biasing force of spring 96 to its latched position in which handle 130 is in its second position 130'. Further closing of the hood to its fully closed position causes enlarged head 190 of stud 182 to enter socket 194 while spring cup 186 engages flange 196 surrounding that socket and forces coil spring 184 and spring cup 186 to a compressed state. The conical shape of enlarged head 190 forces release lever 198 out of socket 194 until the largest diameter portion of the head 190 moves past edge 202 of the release lever. The biasing force of spring 216 then returns the lever into the socket and against the side of stud 182 thereby engaging and trapping the enlarged head and holding the stud and hood 12' in latched position until lever 198 is again released. It will be understood that stud 182 serves as a guide for the sliding movement of cup 186 under the force of spring 184 and prevents that spring from being forced away from the axis of the spring during compression or release.

Should the fasteners received in apertures 169 which secure the upper mounting plate 162 including secondary latch assembly 80, stud 182, spring 184 and spring cup 186 to the underside of hood 12' become loose or fail during use, safety retaining arm 92 on the upper end of secondary latch arm 82 will engage the back side of the sheet metal under hood 12' and prevent the hood 12' from opening fully even when the vehicle is in motion just as in latch assembly 10 described above. Latch assembly 160 therefore provides an alternative spring-stud retainer or plunger-type primary latch for use with the swing-out handle 130 and secondary latch assembly 80 to allow the invention to be used on a wider variety of vehicles and pivotal members.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. In a vehicle having a pivotal member movably mounted on a fixed portion of the vehicle, the pivotal member being movable between open and closed positions and defining a gap between an edge of the pivotal member and the fixed vehicle portion when the pivotal member is in an open position, an improved latch assembly for securing the pivotal member to the fixed vehicle portion comprising:

primary latch means adapted for mounting on one of the pivotal member and fixed vehicle portion and movable between a latched position for retaining a striker member on the other of the pivotal member and fixed vehicle portion and an unlatched position for releasing the striker member;

secondary latch means adapted for mounting on one of the pivotal member and fixed vehicle portion and movable between a latched position for holding said pivotal member partially opened when said primary latch means is unlatched and released and an unlatched position allowing the pivotal member to be fully opened;

movable handle means for moving said secondary latch means betwen said latched and unlatched positions;

mounting means for mounting said movable handle means on the same pivotal member or fixed vehicle portion on which said secondary latch means is mounted and moving said handle means from a first position withdrawn from the gap between the pivotal member and the fixed vehicle portion into a second position in the gap when said primary latch means is unlatched and released whereby said handle means is positioned for easy access in the gap to move said secondary latch means to said unlatched position to fully open the pivotal member after said primary latch means is released.

2. The assembly of claim 1 wherein said mounting means include means for pivotally mounting said movable handle for swinging, pivotal movement into the gap in a plane generally parallel to an edge of the pivotal member or fixed vehicle portion on which said movable handle means is mounted.

3. The assembly of claim 1 wherein said means for moving said movable handle means include biasing means for biasing said handle means from its first to its second position.

4. The assembly of claim 3 including spring means for biasing the pivotal member of the vehicle toward an open position.

5. The assembly of claim 3 wherein said primary latch means include a primary latch member movably mounted on one of the pivotal member and fixed vehicle portion and releasable means for moving said primary latch member between said latched and unlatched positions.

6. The assembly of claim 5 including a mounting plate; said mounting plate including a recess for receiving the striker member; said primary latch member having a keeper surface; means for pivotally mounting said primary latch member on said mounting plate adjacent said recess for pivotal movement between a latched position in which said keeper surface extends across said recess to retain the striker member in said recess and an unlatched position in which said keeper surface is moved away from said recess to release the striker member; said releasable means including a latch pawl pivotally mounted on said mounting plate for engaging and holding said primary latch member in said latched position and biasing means for biasing said primary latch member toward its unlatched position.

7. The assembly of claim 6 wherein said biasing means include a spring connected between said latch pawl and said primary latch member; said releasable means further including a release lever pivotally mounted on said mounting plate for moving said latch pawl to move said primary latch member to said unlatched position and second biasing means for biasing said release lever into position for holding said primary latch member in its latched position.

8. The assembly of claim 7 wherein said second biasing means include a spring connected between said release lever and said mounting plate; and cable means for pivoting said release lever to move said latch pawl and release said primary latch member from a remote location.

9. The assembly of claim 6 wherein said primary latch member also includes a return flange for engaging the striker member to return the primary latch member to said latched position; said latch pawl including surface means for engaging said return flange to hold said primary latch member in latched position.

10. The assembly of claim 5 wherein said primary latch member and releasable means are mounted on one of the pivotal member and fixed vehicle portion; said secondary latch means being mounted on the other of the pivotal member and fixed vehicle portion; said assembly also including spring means for biasing the pivotal member on the vehicle toward an open position.

11. The assembly of claim 10 including a first mounting plate having a striker member and said secondary latch means mounted thereon and first fastening means for securing said first mounting plate to the other of the pivotal member and fixed vehicle portion; and a second mounting plate having an opening for receiving said striker member therein and second fastening means for securing said second mounting plate to the one of the pivotal member and fixed vehicle portion; said primary latch member being movably mounted adjacent said opening on said second mounting plate for movement into said opening to engage and hold said striker member in said latched position.

12. The assembly of claim 11 wherein said striker member is a stud extending outwardly from said first mounting plate and having an enlarged head at its free end; said second mounting plate including a socket defining said opening and receiving said stud and enlarged head when the pivotal member is closed and said primary latch means is in its latched position; said primary latch member including a release lever pivotally mounted adjacent said socket; said socket including an opening extending through one side through which said release lever pivotally moves to engage said stud and enlarged head to retain said stud in said socket.

13. The assembly of claim 12 wherein said spring means is a coil spring mounted concentrically with said stud and extending beyond said enlarged head in its uncompressed state; said releasable means including additional biasing means for biasing said release lever into said opening in said socket and means for pivoting said release lever out of said opening against the biasing force of said additional biasing means.

14. The assembly of claim 13 including a cup telescoped over and slidable along said stud, said coil spring engaging and biasing said cup over and against said enlarged head when uncompressed.

15. The assembly of claim 4 including a mounting plate; said secondary latch means including a secondary latch arm with a recess for receiving a keeper member on the vehicle, pivot means for pivotally mounting said secondary latch arm on said mounting plate for movement between latched and unlatched positions, and additional biasing means for biasing said secondary latch arm into said latched position.

16. The assembly of claim 15 wherein said secondary latch arm is J-shaped; said pivot means engaging said secondary latch arm near the top of said J; said additional biasing means including a spring mounted on said pivot means and engaging said secondary latch arm at a position spaced from said pivot means.

17. The assembly of claim 15 including fastening means for securing said mounting plate to one of the pivotal member and fixed vehicle portion; and safety retaining means on said assembly for engaging a portion of the pivotal member or fixed vehicle portion to which said assembly is secured when said fastening means are loose or released whereby said pivotal member will be maintained at least partially closed even if said fastening means are loose or accidentally fail.

18. The assembly of claim 17 wherein said safety retaining means include a safety arm extending from said secondary latch arm and adapted to be positioned behind a portion of the pivot member or fixed vehicle portion to which said secondary latch means is mounted.

19. The assembly of claim 15 wherein said movable handle means and mounting means for said movable handle means are spaced from said secondary latch means on said mounting plate; said movable handle means including connecting means for engaging said secondary latch means for moving said secondary latch means with said movable handle means.

20. The assembly of claim 19 wherein said movable handle means include a pivotable handle; said mounting means including handle pivot means for pivotally mounting said handle on said mounting plate; said connecting means including a link pivotally connected to said handle and said secondary latch means.

21. The assembly of claim 20 wherein said connecting means further include a latch lever and means for pivotally mounting said latch lever on said secondary latch arm for movement between first and second positions on said latch arm; said link being pivotally secured to said latch lever.

22. The assembly of claim 21 wherein said biasing means for biasing said handle include a spring mounted on said handle pivot means and engaging said handle at a position spaced from said handle pivot means; said latch lever including stop means for limiting movement between said two positions; said spring moving said handle to said second position and simultaneously moving said link and said latch lever to its second position when said primary latch means is released and said latch lever is moved out of engagement with the keeper member on the vehicle, said latch lever and latch arm being further pivotable in unison to said unlatched position when said handle is pivoted beyond said second position.

23. The assembly of claim 4 wherein said mounting means further include lost motion means for moving said movable handle means to said second position without moving said secondary latch means to its unlatched position; said movable handle means being movable beyond said second position to move said secondary latch means to said unlatched position.

24. The assembly of claim 4 wherein said primary latch means, secondary latch handle means, mounting means and spring means are assembled on a single mounting plate; said mounting plate also including fastening means for securing said mounting plate to one of the pivotal member and fixed vehicle portion.

25. The assembly of claim 1 wherein said assembly is mounted on an engine hood of a vehicle.

26. In a vehicle having a pivotal member movably mounted on a fixed portion of the vehicle, an improved latch assembly for securing the pivotal member to the fixed vehicle portion, the pivotal member being movable between open and closed positions, the vehicle being of the type having a striker member and a secondary keeper member secured to one of the fixed portion and pivotal member and adapted to engage said latch assembly, said improved latch assembly being secured to the other of the fixed portion and pivotal member and comprising:

mounting plate means for securing said assembly to the vehicle;

primary latch means on said mounting plate means and movable between a latched position for engaging and retaining the striker member to hold the pivotal member in its closed position and an unlatched position in which the striker member is released;

secondary latch means on said mounting plate means and movable between a latched position for engaging the secondary keeper member and holding the pivotal member in a partially opened position after said primary latch member is released and an unlatched position in which said secondary keeper member is not engaged thereby, the pivotal member defining a gap with the fixed vehicle portion when the pivotal member is partially opened;

swing-out handle means on said mounting plate means for moving said secondary latch means between said latched and unlatched positions;

securing means for movably mounting said swing-out handle means on said mounting plate means for movement between three positions including a first nonaccessible position in which said handle means is withdrawn from the gap when the pivotal member is closed, a second accessible position in which said handle means is extended into the gap after said primary latch means is released, and a third position in which said handle means is further extended into the gap beyond said second accessible position and in which said secondary latch means is unlatched to allow the pivotal member to fully open;

biasing means for biasing said handle means into said second accessible position when said primary latch means is released.

27. The latch assembly of claim 26 wherein said primary means include a primary latch member movably mounted on said mounting plate means and releasable means for moving said primary latch member between said latched and unlatched positions.

28. The assembly of claim 27 wherein said releasable means include a latch pawl and a release lever each pivotally mounted on said mounting plate means, additional biasing means for biasing said latch pawl and release lever toward said primary latch member to hold said primary latch member in latched position, and cable means for pivoting said release lever and latch pawl to move said primary latch member to its unlatched position.

29. The assembly of claim 26 wherein said secondary latch means includes a secondary latch arm on said mounting plate means, said secondary latch arm having a recess for receiving the secondary keeper member, pivot means for pivotally mounting said secondary latch arm on said mounting plate means for movement between latched and unlatched positions, and additional biasing means for biasing said secondary latch arm into said latched position.

30. The assembly of claim 29 including fastening means for securing said mounting plate means to one, of the pivotal member and fixed vehicle portion; and safety retaining means on said assembly for engaging a portion of the pivotal member or fixed vehicle portion to which said assembly is secured when said fastening means are loose or released whereby said pivotal member will be maintained at least partially closed even if said fastening means are loose or accidentally fail.

31. The assembly of claim 29 wherein said swing-out handle means and securing means for said swing-out handle means are spaced from said secondary latch means on said mounting plate means; said swing-out handle means including connecting means for engaging said secondary latch means for moving said secondary latch means with said swing-out handle means.

32. The assembly of claim 31 including lost motion means between said swing-out handle means and secondary latch means for moving said swing-out handle means to said second accessible position without moving said secondary latch means to its unlatched position.

33. The assembly of claim 26 including lost motion means between said swing-out handle means and secondary latch means for moving said swing-out handle means to said second accessible position without moving said secondary latch means to its unlatched position.

34. The assembly of claim 26 wherein said mounting plate means also includes spring means for biasing the pivotal member of the vehicle toward an open position and fastening means for securing said mounting plate means to one of the pivotal member and fixed vehicle portion.

35. In a vehicle having a pivotal member movably mounted on a fixed portion of the vehicle, an improved latch assembly for securing the pivotal member to the fixed vehicle portion, the pivotal member being movable between open and closed positions, the vehicle being of the type having a striker member and a secondary keeper member adapted to engage portions of said latch assembly, said improved latch assembly comprising:

primary latch means on one of the pivotal member and fixed vehicle portion and movable between a latched position for engaging and retaining the striker member to hold the pivotal member in its closed position and an unlatched position in which the striker member is released, the striker member being on the other of the pivotal member and fixed vehicle portion;

secondary latch means on one of the pivotal member and fixed vehicle portion and movable between a latched position for engaging the secondary keeper member and holding the pivotal member in a partially opened position after said primary latch member is released and an unlatched position in which said secondary keeper member is not engaged thereby, the pivotal member defining a gap with the fixed vehicle portion when the pivotal member is partially opened;

spring means for biasing the pivotal member of the vehicle toward an open position;

swing-out handle means on the one of the pivotal member and fixed vehicle portion to which said secondary latch means is mounted for moving said secondary latch means between said latched and unlatched positions;

securing means for movably mounting said swing-out handle means on the one pivotal member and fixed vehicle portion for movement between three positions including a first nonaccessible position in which said handle means is withdrawn from the gap when the pivotal member is closed, a second accessible position in which said handle means is extended into the gap after said primary latch means is released, and a third position in which said handle means is further extended into the gap beyond said second accessible position and in which said secondary latch means is unlatched to allow the pivotal member to fully open;

biasing means for biasing said handle means into said second accessible position when said primary latch means is released.

36. The assembly of claim 35 including a first mounting plate having a striker member and said secondary latch means mounted thereon and first fastening means for securing said first mounting plate to one of the pivotal member and fixed vehicle portion; and a second mounting plate having an opening for receiving said striker member therein and second fastening means for securing said second mounting plate to the other of the pivotal member and fixed vehicle portion; said primary latch means including a primary latch member and releasable means for moving said primary latch member between said latched and unlatched positions; said primary latch member being movably mounted adjacent said opening on said second mounting plate for movement into said opening to engage and hold said striker member in said latched position.

37. The assembly of claim 36 wherein said striker member is a stud extending outwardly from said first mounting plate and having an enlarged head at its free end; said second mounting plate including a socket defining said opening and receiving said stud and enlarged head when the pivotal member is closed and said primary latch means is in its latched position; said primary latch member including a release lever pivotally mounted adjacent said socket; said socket including an opening extending through one side through which said release lever pivotally moves to engage said stud and enlarged head to retain said stud in said socket.

38. The assembly of claim 37 wherein said spring means is a coil spring mounted concentrically with said stud and extending beyond said enlarged head in its uncompressed state; said releasable means including additional biasing means for biasing said release lever into said opening in said socket and means for pivoting said release lever out of said opening against the biasing force of said additional biasing means.

39. The assembly of claim 35 including a first mounting plate; said secondary latch means including a secondary latch arm having a recess for receiving the secondary keeper member, pivot means for pivotally mounting said secondary latch arm on said first mounting plate for movement between latched and unlatched positions, and additional biasing means for biasing said secondary latch arm into said latched position.

40. The assembly of claim 39 wherein said swing-out handle means and securing means for said swing-out handle means are spaced from said secondary latch means on said first mounting plate; said swing-out handle means including connecting means for engaging said secondary latch means for moving said secondary latch means with said swing-out handle means.

41. The assembly of claim 35 including lost motion means between said swing-out handle means and secondary latch means for moving said swing-out handle means to said second accessible position without moving said secondary latch means to its unlatched position.

42. The assembly of claim 35 including fastening means for securing said secondary latch means to one of the pivotal member or fixed vehicle portion; and safety retaining means on said secondary latch means for engaging a portion of the pivotal member or fixed vehicle portion to which said secondary latch means is mounted when said fastening means are loose or released whereby said pivotal member will be maintained at least partially closed even if said fastening means are loose or accidentally fail.

43. In a vehicle having a pivotal member movably mounted on a fixed portion of the vehicle and movable between open and closed positions, the vehicle including a striker member secured to one of the fixed portion and pivotal member on the vehicle, an improved latch assembly for vehicles for releasably securing the pivotal member to the fixed vehicle portion, said latch assembly comprising:

primary latch means on one of the pivotal member and fixed vehicle portion for engaging and releasably holding the striker member on the vehicle to releasably hold the pivotal member in closed position;

a mounting plate and fastening means for securing said mounting to one of the pivotal member and fixed vehicle portion;

safety retaining means on said mounting plate for engaging a portion of the pivotal member or fixed vehicle portion to which mounting plate is secured when said fastening means are loose or released whereby said pivotal member will be maintained at least partially closed even if said fastening means are loose or accidentally fail, said safety retaining means including arm means positioned behind a portion of said one of the pivotal member and fixed vehicle portion to which said mounting plate is secured.

44. The assembly of claim 43 wherein the vehicle also includes a keeper member secured to one of the fixed portion and pivotal member of the vehicle; a secondary latch means secured to one of the pivotal member and fixed vehicle portion for engaging and releasably holding the keeper member on the vehicle to releasably hold the pivotal member in partially opened position after said primary latch means has been released.

45. The assembly of claim 44 wherein said arm means include a safety arm extending from said secondary latch means.

46. The assembly of claim 44 wherein said primary latch means include a primary latch member movably mounted on the one pivotal member or fixed vehicle portion and releasable means for moving said primary latch member between said latched and unlatched positions.

47. The assembly of claim 46 wherein said secondary latch means includes a secondary latch arm on said mounting plate; said secondary latch arm having a recess for receiving the keeper member, pivotal means for pivotally mounting said secondary latch arm on the mounting plate for movement between latched and unlatched positions, and additional biasing means for biasing said secondary latch arm into said latched position.

48. The assembly of claim 47 including a swing-out handle and securing means for securing said swing-out handle on said mounting plate at a position spaced from said secondary latch means; said swing-out handle including connecting means for engaging said secondary latch arm for moving said secondary latch arm with said swing-out handle.

49. The assembly of claim 48 including lost motion means between said swing-out handle and secondary latch arm for moving said swing-out handle to an accessible position without moving said secondary latch arm to its unlatched position

50. The assembly of claim 49 wherein said mounting plate also includes spring means for biasing the pivotal member of the vehicle toward an open position and fastening means for securing said mounting plate to one of the pivotal member and fixed vehicle portion.

51. In a vehicle having a pivotal member movably mounted on a fixed portion of the vehicle and movable between open and closed positions, the vehicle including a striker member and a keeper member secured to one of the fixed portion and pivotal member on the vehicle, an improved latch assembly for vehicles for releasably securing the pivotal member to the fixed vehicle portion, said assembly comprising:

a mounting plate secured to one of the pivotal member and fixed vehicle portion;

primary latch means on said mounting plate for engaging and releasably holding the striker member on the vehicle to releasably hold the pivotal member in closed position;

secondary latch means on said mounting plate for engaging and releasably holding the keeper on the vehicle to releasably hold the pivotal member in partially open position after said primary latch means has been released;

spring means on said mounting plate for biasing the pivotal member toward its open position;

release means on said mounting plate for releasing said primary and secondary latch means to open the pivotal member;

fastening means for securing said mounting plate to said one of the pivotal member and fixed vehicle portion; and safety retaining means on said assembly for engaging a portion of said one of the pivotal member or fixed vehicle portion to which said assembly is secured when said fastening means are loose or released such that said pivotal member will be maintained at least partially closed even if said fastening means are loose or accidentally fail;

whereby said assembly is mounted to the vehicle as a single unit with said primary secondary latch means, release means, spring means and safety retaining means all assemblyed on one mounting plate for simplified installation and repair.

52. The assembly of claim 51 wherein said release means includes movable handle means for said secondary latch means between said latched and unlatched positions and lever means for releasing said primary latch means.

53. In a vehicle having a pivotal member movably mounted on a fixed portion of the vehicle and movable between open and closed positions, the pivotal member defining a gap with the fixed vehicle portion when the pivotal member is partially opened, the vehicle including a striker member and a keeper member secured to one of the fixed portion and pivotal member on the vehicle, an improved latch assembly for vehicles for releasably securing the pivotal member to the fixed vehicle portion, said latch assembly comprising:

a mounting plate secured to one of the pivotal member and fixed vehicle portion;

primary latch means on said mounting plate for engaging and releasably holding the striker member on the vehicle to releasably hold the pivotal member in closed position;

secondary latch means on said mounting plate for engaging and releasably holding the keeper on the vehicle to releasably hold the pivotal member in partially opened position after said primary latch means has been released;

spring means on said mounting plate for biasing the pivotal member toward its open position;

release means on said mounting plate for releasing said primary and secondary latch means to open the pivotal member; said release means including movable handle means for moving said secondary latch means between said latched and unlatched positions and lever means for releasing said primary latch means;

securing means for movably mounting said movable handle means on said mounting plate for movement between three positions including a first nonaccessible position in which said handle means is withdrawn from the gap when the pivotal member is closed, a second accessible position in which said handle means is extended into the gap after said primary latch means is released, and a third position in which said handle means is further extended into the gap beyond said second accessible positin and in which said secondary latch means is unlatched to allow the pivotal member to fully open; biasing means for biasing said handle means into said second accessible position when said primary latch means is released; and fastening means for securing said mounting plate to one of the pivotal member and fixed vehicle portion whereby said assembly is mounted to the vehicle as a single unit with said primary and secondary latch means, release means and spring means all assembled on one mounting plate for simplified installation and repair.

* * * * *

UNITED STATES PATENT AND TRADEMARK OFFICE

CERTIFICATE OF CORRECTION

PATENT NO. : 4,756,562

DATED : July 12, 1988

INVENTOR(S) : Raymond E. Foster et al.

It is certified that error appears in the above-identified patent and that said Letters Patent is hereby corrected as shown below:

Column 6, line 18:

Delete "6" and insert --36--.

Column 6, line 61:

Delete "releas" and insert --release--.

Column 9, line 50:

Delete "1" and insert --12--.

Column 14, line 53:

Delete "betwen" and insert --between--.

Column 18, line 20:

Delete "latch".

Column 18, lines 20 and 21:

After "primary" insert --latch--.

Column 18, line 44:

Delete "one," and insert --one--.

Column 21, line 36:

Delete "pivotal" and insert --pivot--.

UNITED STATES PATENT AND TRADEMARK OFFICE

CERTIFICATE OF CORRECTION

PATENT NO. : 4,756,562

DATED : July 12, 1988 PAGE 2 OF 2

INVENTOR(S) : Raymond E. Foster et al.

It is certified that error appears in the above-identified patent and that said Letters Patent is hereby corrected as shown below:

Column 22, line 26:

After "primary" insert --and--.

Column 22, line 31:

Delete "includes" and insert --include--.

Column 22, line 31:

After "for" insert --moving--.

Column 23, line 6:

Delete "positin" and insert --position--.

Signed and Sealed this

Twenty-ninth Day of November, 1988

*Attest:*

DONALD J. QUIGG

*Attesting Officer*

*Commissioner of Patents and Trademarks*